US009982208B2

(12) United States Patent
Wang et al.

(10) Patent No.: US 9,982,208 B2
(45) Date of Patent: May 29, 2018

(54) DIESEL FUEL COMPOSITIONS

(71) Applicant: YASHENTECH CORPORATION, Shanghai (CN)

(72) Inventors: Youqi Wang, Shanghai (CN); Ziyun Li, Shanghai (CN); Guoming Zhang, Shanghai (CN); Zhijian Li, Shanghai (CN); Gary Wuqi Cao, Shanghai (CN)

(73) Assignee: YASHENTECH CORPORATION, Zhangjiang Hitech Park, Pudong, Shanghai (CN)

( * ) Notice: Subject to any disclaimer, the term of this patent is extended or adjusted under 35 U.S.C. 154(b) by 0 days. days.

(21) Appl. No.: 14/883,536

(22) Filed: Oct. 14, 2015

(65) Prior Publication Data

US 2017/0081606 A1 Mar. 23, 2017

(30) Foreign Application Priority Data

Sep. 23, 2015 (CN) ..... 2015 1 06114284

(51) Int. Cl.

| | |
|---|---|
| ***C10L 10/06*** | (2006.01) |
| ***C10L 1/18*** | (2006.01) |
| ***C10L 10/16*** | (2006.01) |
| ***C10L 10/14*** | (2006.01) |
| ***C10L 10/08*** | (2006.01) |
| ***C10L 10/04*** | (2006.01) |
| ***C10L 1/22*** | (2006.01) |

(Continued)

(52) U.S. Cl.

CPC ..... *C10L 10/06* (2013.01); *C10L 1/14* (2013.01); *C10L 1/18* (2013.01); *C10L 1/22* (2013.01); *C10L 10/04* (2013.01); *C10L 10/08* (2013.01); *C10L 10/12* (2013.01); *C10L 10/14* (2013.01); *C10L 10/16* (2013.01); *C10L 1/1608* (2013.01); *C10L 1/185* (2013.01); *C10L 1/1811* (2013.01); *C10L 1/1824* (2013.01); *C10L 1/1832* (2013.01); *C10L 1/1857* (2013.01); *C10L 1/19* (2013.01); *C10L 1/1905* (2013.01); *C10L 1/1973* (2013.01); *C10L 1/223* (2013.01); *C10L 1/224* (2013.01); *C10L 1/231* (2013.01); *C10L 1/232* (2013.01); *C10L 2200/0259* (2013.01); *C10L 2200/0446* (2013.01); *C10L 2250/04* (2013.01); *C10L 2270/026* (2013.01); *C10L 2290/24* (2013.01)

(58) Field of Classification Search

CPC combination set(s) only.
See application file for complete search history.

(56) References Cited

U.S. PATENT DOCUMENTS

| | | | |
|---|---|---|---|
| 2,089,580 | A | 8/1937 | Schulze |
| 2,104,021 | A | 1/1938 | Callis |

(Continued)

FOREIGN PATENT DOCUMENTS

| | | | |
|---|---|---|---|
| CN | 101812336 | A1 | 8/2010 |
| CN | 103805297 | A1 | 11/2012 |

(Continued)

*Primary Examiner* — Ellen McAvoy
*Assistant Examiner* — Chantel Graham
(74) *Attorney, Agent, or Firm* — Jun He Law Offices P.C.; James J. Zhu

(57) ABSTRACT

The present disclosure provides a diesel fuel composition containing DMC and multifunctional additives to reduce particulate emission, improve efficiency and be used in cold and/or hypoxia conditions.

20 Claims, 2 Drawing Sheets

(51) Int. Cl.

| | |
|---|---|
| ***C10L 10/12*** | (2006.01) |
| ***C10L 1/14*** | (2006.01) |
| *C10L 1/23* | (2006.01) |
| *C10L 1/19* | (2006.01) |
| *C10L 1/182* | (2006.01) |
| *C10L 1/185* | (2006.01) |
| *C10L 1/16* | (2006.01) |
| *C10L 1/183* | (2006.01) |
| *C10L 1/197* | (2006.01) |
| *C10L 1/223* | (2006.01) |
| *C10L 1/224* | (2006.01) |
| *C10L 1/232* | (2006.01) |

(56) References Cited

U.S. PATENT DOCUMENTS

| | | | | |
|---|---|---|---|---|
| 2,311,386 | A | 2/1943 | Hasselstrom | |
| 3,270,497 | A | 9/1966 | Malick | |
| 4,891,049 | A | 1/1990 | Dillon et al. | |
| 4,904,279 | A | 2/1990 | Kanne et al. | |
| 5,425,790 | A | 6/1995 | Liotta, Jr. et al. | |
| 6,387,138 | B1 | 5/2002 | Murayama et al. | |
| 2005/0044778 | A1* | 3/2005 | Orr | C10L 1/12 44/320 |
| 2010/0210492 | A1* | 8/2010 | Lange | C10L 1/14 508/221 |

FOREIGN PATENT DOCUMENTS

| | | | |
|---|---|---|---|
| CN | 103450956 | A1 | 12/2013 |
| CN | 104830382 | A1 | 8/2015 |

* cited by examiner

DIESEL FUEL COMPOSITIONS

CROSS-REFERENCE TO RELATED APPLICATIONS

This application claims priority to Chinese Patent Application No. 2015106114284, filed Sep. 23, 2015, the disclosure of which is incorporated herein by reference.

FIELD OF THE INVENTION

The present invention generally relates to diesel fuel compositions, their preparation and their use.

BACKGROUND OF THE INVENTION

Diesel fuel, due to its performance, efficiency and safety advantages, is widely used in many types of transportation, such as trucks, trains, boats and aircrafts, as well as farm and construction equipment. On the other hand, diesel engines emit significant amount of soot (i.e., particulate matter), especially when running without enough oxygen, which draws a serious environmental concern.

Methods for decreasing soot emission from diesel engines have been developed by using additive components, such as methanol, alcohol, alkyl ethers (see, e.g., U.S. Pat. Nos. 2,089,580, 2,104,021, 3,270,497, and 5,425,790), bio-diesel and dimethyl carbonate (DMC).

Several attempts have been made to use DMC to treat diesel fuel. For example, U.S. Pat. No. 4,891,049 to Dillon et al. has described that diesel fuel containing 5% DMC has 10~30% reduction of particulate emissions. U.S. Pat. No. 6,387,138 to Murayama et al. discloses that 10% DMC can suppress 50% or more particulate emission in diesel fuels. Other examples can be found in U.S. Pat. Nos. 2,311,386, 4,891,049, 4,904,279, and 5,004,480.

On the other hand, some features of DMC have precluded its wide use as a diesel fuel additive. For example, DMC separates from the fuel mixture at low temperatures, which may paralyze diesel engines. In addition, because DMC has a cetane number of 35~36, which is lower than diesel fuel, excessive amount of DMC in diesel fuel will decrease the cetane number of the diesel fuel mixture, resulting in lowered performance and efficiency.

It is an object of the present invention to provide DMC-containing additive compositions to be used in diesel fuel that can suppress soot emission and at the same time solve the problems of phase separation and low efficiency.

SUMMARY OF THE INVENTION

In one aspect, the present disclosure provides a composition for treating diesel fuel. In certain embodiments, the composition comprises dimethyl carbonate; and a multifunctional additive. In certain embodiments, the multifunctional additive comprises a phase stabilizer present at 20~99 wt % of the multifunctional additive, said phase stabilizer comprising a methyl ester of low carbon number; and a cetane improver present at 0.5~20 wt % of the multifunctional additive.

In certain embodiments, the methyl ester of low carbon number is selected from the group consisting of methyl acetate, methyl acrylate and methyl butyrate.

In certain embodiments, the methyl ester of low carbon number is 80~90 wt % of the phase stabilizer.

In certain embodiments, the phase stabilizer further comprises an alkyl alcohol, an aromatic alcohol, a ketone, an ether, or a combination thereof.

In certain embodiments, the alkyl alcohol is selected from the group consisting of methanol, ethanol, propanol, isopropanol, butanol, iso-butanol, pentanol, iso-pentanol, heptanol, octanol, iso-octanol, decanol or a combination thereof.

In certain embodiments, the aromatic alcohol is selected from the group consisting of benzyl alcohol, and phenethyl alcohol.

In certain embodiments, the ketone is selected from the group consisting of acetone, butanone and 2-butanone.

In certain embodiments, the ether is selected from the group consisting of methyl tert-butyl ether and di-ethylene glycol dimethyl ether.

In certain embodiments, the phase stabilizer comprises diethylene glycol dimethyl ether.

In certain embodiments, the cetane improver is selected from the group consisting of iso-amyl nitrate, iso-octyl nitrate, cyclohexyl nitrate, butyl oxalate, dibutyl oxalate, di-iso-pentyl oxalate, di-tert-butyl peroxide, tert-butyl peroxybenzoate and a combination thereof.

In certain embodiments, the cetane improver is di-tert-butyl peroxide or tert-butyl peroxybenzoate.

In certain embodiments, the multifunctional additive further comprises a solubilizer present at 0~70 wt % of the multifunctional additive.

In certain embodiments, the solubilizer is selected from the group consisting of alkyl carbonate, alkane, dimethylbenzene, ethylbenzene, isopropyl benzene and a combination thereof.

In certain embodiments, the multifunctional additive further comprises a corrosion inhibitor present at 0.001~1 wt % of the multifunctional additive.

In certain embodiments, the corrosion inhibitor is selected from the group consisting of 2,6-di-tert-butyl-4-methylphenol, 2,6-di-tert-butylphenol, N,N-di-tert-butyl-p-phenylenediamine, benzotriazole, tolyltriazole and a combination thereof.

In certain embodiments, the multifunctional additive further comprises a lubricity improver present at 0.01~1 wt % of the multifunctional additive.

In certain embodiments, the lubricity improver is selected from the group consisting of vegetable oils, fatty acids, aliphatic esters, aliphatic amines, ester amides, ester amide derivatives and a combination thereof.

In certain embodiments, the multifunctional additive further comprises a cold flow improver present at 0.01~10 wt % of the multifunctional additive.

In certain embodiments, the cold flow improver comprises vinyl acetate polymer, polymethacrylate, or a combination thereof.

In another aspect, the present disclosure provides a diesel fuel composition comprising a base diesel fuel present at 50~95 wt %; and a composition as disclosed above, wherein the dimethyl carbonate is present at 2~50 wt % of the diesel fuel composition and the multifunctional additive, is present at 0.01~10 wt % of the diesel fuel composition.

In yet another aspect, the present disclosure provides a method for manufacturing the diesel fuel composition. In certain embodiments, the method comprises the steps of preparing the multifunctional additive by mixing the phase stabilizer, the solubilizer, the cetane improver, the corrosion inhibitor, the lubricity improver and the cold flow improver; and then mixing the diesel, the dimethyl carbonate and the multifunctional additive.

In yet another aspect, the present disclosure provides a method for reducing soot emission. In certain embodiments, the method comprises the step of using the diesel fuel composition as disclosed above in a diesel engine.

In certain embodiments, the diesel engine is operated at an altitude of at least 2000 meters.

These and other features, aspects, and advantages of the present invention will become better understood with regard to the following description, appended claims and accompanying drawings.

DETAILED DESCRIPTION OF THE INVENTION

Figure 1:
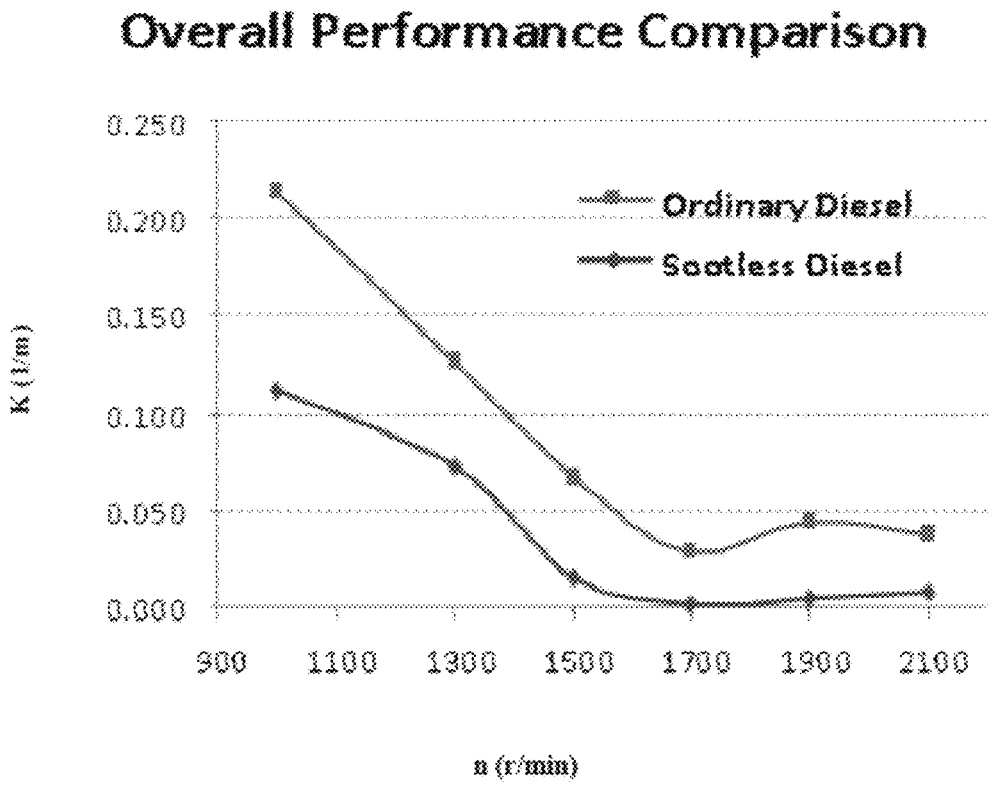
FIG. 1 compares the soot emission of 0#D20A1 (diesel fuel composition containing DMC and the multifunctional additive A1) with normal 0# diesel fuel. The soot emissions in run with 0#D20A1 diesel fuel composition were significantly reduced at all speeds (1000~2100 rpm) as compared to emissions from runs with #0 diesel.

In the Summary of the Invention above and in the Detailed Description of the Invention, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)~(a second number)," this means a range whose lower limit is the first number and whose upper limit is the second number. For example, 25 to 90 wt % means a range whose lower limit is 25 wt %, and whose upper limit is 90 wt %.

In an aspect, the present disclosure provides a DMC-containing additive composition that can improve performance and efficiency of diesel fuels. In certain embodiments, the composition comprises DMC and a multifunctional additive, wherein the multifunctional additive comprises: (1) a phase stabilizer present at 20~99 wt % of the multifunctional additive, said phase stabilizer comprising a methyl ester of low carbon number; and (2) a cetane improver present at 0.5~20 wt % of the multifunctional additive.

As used herein, the term "diesel fuel" refers to any liquid fuel used in diesel engines. A typical specification for a diesel fuel includes a minimum flash point of 100° F., a boiling point range of from about 300° F. to about 700° F., and maximum 90 percent distillation point (ASTM D-86) of 640° F., i.e., 90 percent by volume boils below 640° F. A "base diesel fuel" refers to diesel fuel that is substantially free of DMC or other additives.

The term "phase stabilizer" as used herein refers to a chemical or a chemical composition that can prevent or reduce phase separation of diesel fuel composition. Examples of chemicals that can be used as a phase stabilizer include, without limitation, a alkyl alcohol (e.g., methanol, ethanol, propanol, isopropanol, butanol, pentanol, isopentanol, heptanol, octanol, isooctanol, decanol), an aromatic alcohol (e.g., benzyl alcohol, and phenethyl alcohol), a methyl ester of low carbon number (e.g., methyl acetate, methyl acrylate, methyl butyrate), a ketone (e.g., acetone, butanone and 2-butanone), an ether (e.g., methyl tert-butyl ether and diethylene glycol dimethyl ether) and combinations thereof.

In certain embodiments, the phase stabilizer in the multifunctional additive is present at about 20, 25, 30, 35, 40, 45, 50, 55, 60, 65, 70, 75, 80, 85, 90 or 95 wt % of the multifunctional additive. Preferably 20~30 wt %.

The term "cetane improver" as used herein refers to a chemical or chemical composition that can increase the cetane number of a diesel fuel composition. Cetane number is an indicator of the combustion speed of diesel fuel. Generally, the higher the cetane number the more easily the fuel will combust in a diesel engine. Therefore, higher-cetane fuel usually causes an engine to run more smoothly and quietly, which usually translates into greater efficiency. Examples of chemicals that can be used as a cetane improver include, without limitation, iso-amyl nitrate, iso-octyl nitrate, cyclo-hexyl nitrate, butyl oxalate, dibutyl oxalate, di-iso-pentyl oxalate, di-tert-butyl peroxide, tert-butyl peroxybenzoate and combinations thereof.

The concentration of the cetane improver in the multifunctional additive can be at about 0.5, 1, 1.5, 2, 2.5, 3, 3.5, 4, 4.5, 5, 5.5, 6, 6.5, 7, 7.5, 8, 8.5, 9, 9.5, 10, 11, 12, 13, 14, 15, 16, 17, 18, 19 or 20 wt % of the multifunctional additive. Preferably 0.5~3.0 wt %.

In certain embodiments, the multifunctional additive further comprises a solubilizer present at 0~70 wt %. The term "solubilizer" refers to a chemical or a chemical composition that helps the chemicals in the additive (e.g. ethanol) to blend with diesel and keeps the mixture blend stable. Examples of chemicals that can be used as a solubilizer include, without limitation, alkyl carbonate (e.g., DMC), alkane, dimethylbenzene, ethylbenzene, iso-propyl benzene and combinations thereof. The concentration of solubilizer in the multifunctional additive can be at about 5, 10, 15, 20, 25, 30, 35, 40, 45, 50, 55, 60, 65, 70 wt % of the multifunctional additive. Preferably 5~25 wt %.

In certain embodiments, the multifunctional additive further comprises a corrosion inhibitor present at 0.001~1 wt %. As used herein, the term "corrosion inhibitor" refers to a chemical or a chemical composition that can protect fuel engines from corrosion. Examples of chemicals that can be used as corrosion inhibitors include, without limitation, 2,6-di-tert-butyl-4-methyl phenol, 2,6-di-tert-butyl phenol, N,N-di-tert-butyl-p-phenylene di-amine, benzotriazole, tolyltriazole and combinations thereof. The concentration of the corrosion inhibitor in the multifunctional additive can be at about 0.001, 0.002, 0.003, 0.004, 0.005, 0.006, 0.007, 0.008, 0.009, 0.01, 0.02, 003, 0.04, 0.05, 0.06, 0.07, 0.08, 0.09, 0.1, 0.2, 0.3, 0.4, 0.5, 0.6, 0.7, 0.8, 0.9 or 1 wt %. Preferably 0.002~0.01 wt %.

In certain embodiments, the multifunctional additive further comprises a lubricity improver present at 0.01~1 wt %. The term "lubricity improver" as used herein refers to a chemical or a chemical composition that can improve the lubrication properties of the fuel. Desulfurization is a key for cleaner fuels. However, as the sulfur level in diesel fuel is reduced, the inherent lubricity characteristics of the fuel also deteriorated. Diesel fuels with poor lubricity can result in pump wear and eventually engine failure. Examples of chemicals that can be used as lubricity improver include, without limitation, a vegetable oil, a fatty acid, an aliphatic ester, an aliphatic amine, an ester amide, ester amide derivatives and combinations thereof. The concentration of the lubricity improver in the multifunctional additive can be at about 0.01, 0.02, 0.03, 0.04, 0.05, 0.06, 0.07, 0.08, 0.09, 0.1, 0.2, 0.3, 0.4, 0.5, 0.6, 0.7, 0.8, 0.9 or 1 wt % of the multifunctional additive. Preferably 0.01~0.05 wt %.

In certain embodiments, the multifunctional additive further comprises a cold flow improver present at 0.01~10 wt % of the multifunctional additive. The term "cold flow improver" as used herein refers to a chemical or a chemical composition that can prevent or reduce the precipitation of wax from diesel fuels at low temperatures. Examples of chemicals that can be used as cold flow improver include, without limitation, vinyl acetate polymer, polymethacrylate, or combinations thereof. The concentration of the cold flow improver in the multifunctional additive can be at about 0.01, 0.02, 003, 0.04, 0.05, 0.06, 0.07, 0.08, 0.09, 0.1, 0.2, 0.3, 0.4, 0.5, 0.6, 0.7, 0.8, 0.9, 1, 2, 3, 4, 5, 6, 7, 8, 9 or 10 wt % of the multifunctional additive. Preferably 0.1~0.5 wt %.

In another aspect, the present application relates to a diesel fuel composition with reduced soot emission and improved efficiency. In certain embodiments, the diesel fuel composition comprises: diesel present at 50~95 wt %; dimethyl carbonate present at 2~50 wt %; and a multifunctional additive as disclosed supra, said multifunctional additive is present at 0.01~10 wt %.

As used herein, the term "soot" refers to microscopic solid or liquid particles generated in an engine due to the incomplete combustion of hydrocarbons. As used herein, the term "soot" is interchangeable with "particulate" or "smoke."

In certain embodiments, the diesel fuel composition as disclosed herein comprises a base diesel fuel present at about 50, 60, 70, 75, 80, 85, 90 or 95 wt %. Preferably 70~95 wt %, most preferably 75~90 wt %.

In certain embodiments, the diesel fuel composition as disclosed herein comprises dimethyl carbonate present at about 2, 3, 4, 5, 6, 7, 8, 9, 10, 11, 12, 13, 14, 15, 16, 17, 18, 19, 20, 21, 22, 23, 24, 25, 26, 27, 28, 29, 30, 40, or 50 wt %. Preferably 4.5-30 wt %, most preferably 4.5~25 wt %.

In certain embodiments, the diesel fuel composition as disclosed herein comprises a multifunctional additive present at about 0.01, 0.02, 0.03, 0.04, 0.05, 0.06, 0.07, 0.08, 0.09, 0.1, 0.2, 0.3, 0.4, 0.5, 0.6, 0.7, 0.8, 0.9, 1, 2, 3, 4, 5, 6, 7, 8, 9 or 10 wt %. The concentration of multifunctional additive in the diesel fuel composition can be a concentration bounded by any two of the above endpoints. Preferably 0.5~3 wt %, most preferably 1~2.5 wt %.

In yet another aspect, the present application relates to a method for manufacturing the diesel fuel composition as disclosed supra. In certain embodiments, the method comprises the steps of preparing the multifunctional additive as disclosed supra by mixing the phase stablizer, the solubilizer, the cetane number improver, the metal corrosion inhibitor, the lubricity improver and the cold flow improver, and then mixing the diesel, the dimethyl carbonate and the multifunctional additive together.

In yet another aspect, the present application relates to a method for reducing soot emission. In certain embodiments, the method comprises using the diesel fuel composition disclosed supra in a diesel engine. In certain embodiments, the diesel engine is operated in an altitude of at least 2,000 meters.

The following examples are presented to illustrate the present invention. To those who are skilled in the art, they are not intended to limiting in any manner.

Example 1

The following is an example of diesel fuel compositions containing the multifunctional additive as disclosed herein.

Prepare multifunctional additive A1 according to the formulation in Table 1.

TABLE 1

Formulation of multifunctional additive A1

| Component | Weight Percent |
|---|---|
| Phase stabilizer: methanol | 44.3 |
| Solubilizer: DMC | 44.3 |
| Cetane improver: iso-amyl nitrate | 4.4 |
| Corrosion inhibitor: 2,6-di-tert-butyl-4-methylphenol | 0.2 |
| Lubricity improver: castor oil | 2.2 |
| Cold flow improver: polymethacrylate | 4.4 |

Mix the multifunctional additive A1 (2 wt %) with 0# diesel fuel† (80 wt %) and DMC (18 wt %) to produce 0#D20A1 diesel composition. († Diesel fuel products in China are graded according to their solidifying points. For example, the solidifying point of 0# diesel fuel shall be no higher than 0° C.)

The properties of 0# diesel fuel and 0#D20A1 diesel composition were compared. As shown in Table 2, most features of the 0# D20A1 diesel composition, including oxidation stability, copper corrosion, lubricity, viscosity, solidifying point, cold filter plugging point (CFPP), and density meet the standard to be used in ordinary, conventional diesel engines. Of note, the cetane number of 0#D20A1 is higher than 0# diesel. In contrast, adding DMC to 0# diesel without using the multifunctional additive leads to a decrease of cetane number, causing the diesel composition unusable in ordinary, conventional diesel engines.

Tests to determine soot emissions (smoke at free acceleration) from diesel engines were conducted on a diesel vehicle (Great Wall Haval H5). Soot emission was measured in terms of extinction coefficient (k) of soot with a smoke meter (Opacilyt 1030, Germany). The lower k value means lower soot emission. As shown in Table 2, using 0#D20A1 diesel composition decreased the emission as much as 81.2% compared to using 0# diesel. Bench tests to determine particulate emissions were also conducted on a heavy-duty diesel engine, whose parameters are listed in Table 3. As shown in FIG. 1, in runs with 0#D20A1 diesel composition, the soot emissions were significantly reduced at all speeds (1000~2100 rpm) as compared to emissions from runs with #0 diesel.

TABLE 2

Properties of the 0# D20A1 diesel composition

| Feature | 0# diesel | 0# diesel + 18% DMC | 0# D20A1 |
|---|---|---|---|
| Oxidation Stability/ total insoluble matter (mg/100 mL) | 1.91 | — | 1.86 |
| Copper corrosion | 1a | — | 1a |
| Lubricity | 416 | — | 368 |
| Viscosity ($mm^2/s$) | 4.107 | — | 2.287 |
| Solidifying Point (° C.) | −17 | phase separation at 0° C. | −13 |
| Cold Filter Plugging Point (° C.) | −6 | phase separation at 0° C. | −8 |
| Flash Point (° C.) | 67 | — | 18 |
| Cetane Number | 51.8 | 47.5 | 52.7 |
| Density ($kg/m^3$) | 830.5 | — | 862.0 |
| Soot Emission k (1/m) | 0.410 | | 0.077 |

TABLE 3

Parameters of the heavy-duty diesel engine

| Item | Detail/Parameter |
|---|---|
| Type | In-line, water-cooled, mid cooling, electronic control, direct-injection |
| Cylinder | 6 |
| Bore × Stroke (mm × mm) | 112 × 145 |
| Maximum Power kW (r/min) | 201 (2100) |
| Maximum Torque Nm (r/min) | 1500 (1300) |
| Displacement (L) | 8.75 |
| Compression Ratio | 17 |

Example 2

The following example compared the particulate-emission-reduction effects of diesel fuel compositions with different percentage of DMC and multifunctional additive.

Mix the multifunctional additive A1 (see EXAMPLE 1) (1 wt %) with 0# diesel fuel (90 wt %) and DMC (9 wt %) to produce 0#D10A1 diesel composition.

Mix the multifunctional additive A1 (see EXAMPLE 1) (0.5 wt %) with 0# diesel fuel (95 wt %) and DMC (4.5 wt %) to produce 0#D5A1 diesel composition.

Tests to determine emissions of particulates from diesel engines were conducted on two heavy-duty diesel trucks. As shown in Table 4, the results demonstrated that the diesel composition containing DMC with the multifunctional additive (A1) could significantly decrease soot emission from the diesel trucks. Moreover, as the concentration of DMC and multifunctional additive in the diesel composition increased, the emission-decreasing effects of the diesel fuel were also improved.

TABLE 4

Soot emission tests of diesel fuel compositions containing DMC with multifunctional additive A1

| | Soot emission k (1/m) | | Percent of soot emission decrease | |
|---|---|---|---|---|
| | Vehicle #1 | Vehicle #2 | Vehicle #1 | Vehicle #2 |
| 0# diesel fuel | 0.728 | 0.927 | — | — |
| 0# D5A1 | 0.545 | 0.727 | 25% | 22% |
| 0# D10A1 | 0.358 | 0.578 | 51% | 38% |
| 0# D20A1 (see Example 1) | 0.228 | 0.243 | 69% | 74% |

Example 3

The following is an example of diesel compositions containing the multifunctinal additive as disclosed herein.

Prepare multifunctional additive A2 according to the formulation in Table 4.

TABLE 4

Formulation of multifunctional additive A2

| Component | Weight Percent |
|---|---|
| Phase stabilizer: methanol | 49.0 |
| Solubilizer: DMC | 34.3 |
| Cetane improver: di-tert-butyl peroxide | 14.7 |
| Corrosion inhibitor: 2,6-di-tert-butyl-4-methylphenol, T1201, methyl benzene benzotriazole | 1.0 |
| Lubricity improver: palmitic acid | 0.5 |
| Cold flow improver: polymethacrylate | 0.5 |

Mix the multifunctional additive A2 (2 wt %) with 0# diesel fuel (80 wt %) and DMC (18 wt %) to produce 0#D20A2 diesel composition.

The diesel composition containing DMC with the multifunctional additive (A2) 0#D20A2 could significantly decrease soot emission from a diesel vehicle (Great Wall Haval H5). 0#D20A2 decreased the emission as much as 75% compared to using 0# normal diesel.

Example 4

The following is an example of the multifunctional additive as disclosed herein and its effect in preventing phase separation.

Prepare multifunctional additive A3 according to the formulation in Table 5.

TABLE 5

Formulation of multifunctional additive A3

| Component | Weight Percent |
|---|---|
| Phase stabilizer: ethanol, octanol | 68.7 |
| Solubilizer: DMC | 21.7 |
| Cetane improver: di-tert-butyl peroxide | 8.3 |

TABLE 5-continued

| Formulation of multifunctional additive A3 | |
|---|---|
| Component | Weight Percent |
| Corrosion inhibitor: 2,6-di-tert-butyl-4-methylphenol | 0.4 |
| Lubricity improver: methyl oleate | 0.4 |
| Cold flow improver: polymethacrylate | 0.4 |

Mix the multifunctional additive A3 (2 wt %) with −10# diesel fuel (80 wt %) and DMC (18 wt %) to produce −10#D20A3 diesel fuel composition.

Mix the multifunctional additive A3 (1 wt %) with −10# diesel fuel (90 wt %) and DMC (9 wt %) to produce −10#D10A3 diesel fuel composition.

The properties of the −10#D20A3 diesel composition were tested by observing the phase separation of the composition when the temperature was slowly decreased (one degree Celsius for every two minutes). The results showed that no phase separation was observed in −10#D20A3 diesel composition until it was solidified at −11° C. Nor was any phase separation observed when the −10#D20A3 diesel composition was re-heated to room temperature. In contrast, −10# mix diesel made up of −10# diesel and 18% DMC (without additives) had phase separation at −4° C., indicating that the −10# mix diesel did not meet the standard to be used as −10# diesel fuel. The Cold Filter Plugging Point (CFPP) of the −10#D20A3 diesel composition was −6° C. while the CFPP of the −10# diesel could not be measured due to phase separation at −4° C.

TABLE 6

| Solidifying point and CFPP of −10# D20A3 diesel fuel composition | | |
|---|---|---|
| | Solidifying point (° C.) | Cold Filter Plugging Point (° C.) |
| −10# diesel fuel | −10 | −5 |
| −10# mix diesel (−10# diesel + 18% DMC) | Phase separation at −4° C. | Phase separation at −4° C. |
| −10# D20A3 | −11 | −6 |

Example 5

The following is an example of the multifunctional additive as disclosed herein and its effect in preventing phase separation.

Prepare multifunctional additive A4 according to the formulation in Table 7.

TABLE 7

| Formulation of multifunctional additive A4 | |
|---|---|
| Component | Weight Percent |
| Phase stabilizer: isopropanol | 42.9 |
| Solubilizer: n-heptane | 42.9 |
| Cetane improver: ethylhexyl nitrate | 8.6 |
| Corrosion inhibitor: N,N-di-tert-butyl-p-phenolenediamine, methyl benzene benzotriazole | 0.4 |
| Lubricity improver: palmitic acid | 0.9 |
| Cold flow improver: polyethylene-vinyl acetate | 4.3 |

Mix the multifunctional additive A4 (1 wt %) with −20# diesel fuel (90 wt %) and DMC (9 wt %) to produce −20#D10A4 diesel fuel composition.

The properties of the −20#D10A4 diesel composition were tested by observing the phase separation of the diesel when the temperature was slowly decreased (one degree Celsius for every two minutes). The results showed that no phase separation was observed in −20#D10A4 diesel composition until it was solidified at −21° C. Nor was any phase separation observed when the −20#D10A4 diesel composition was re-heated to room temperature. In contrast, −20# mix diesel made up of −20# diesel and 9% DMC (without additives) had phase separation at −11° C., indicating that the −20# mix diesel did not meet the standard to be used as −20# diesel fuel. The Cold Filter Plugging Point (CFPP) of the −10#D10A4 diesel composition was −15° C. while the CFPP of the −10# diesel could not be measured due to phase separation at −11° C.

TABLE 8

| Solidifying point and CFPP of −10#D20A4 diesel fuel composition | | |
|---|---|---|
| | Solidifying Point (° C.) | Cold Filter Plugging Point (° C.) |
| −20# diesel fuel | −20 | −14 |
| −20# mix diesel (−20# diesel + 9% DMC) | Phase separation at −11° C. | Phase separation at −11° C. |
| −20# D10A4 | −21 | −15 |

Example 6

The following is an example of the multifunctional additive as disclosed herein and its effect in preventing phase separation.

Prepare multifunctional additive A5 according to the formulation in Table 9.

TABLE 9

| Formulation of multifunctional additive A5 | |
|---|---|
| Component | Weight Percent |
| Phase stabilizer: tert-butanol | 43.7 |
| Solubilizer: iso-octane | 43.7 |
| Cetane improver: peroxy benzoate | 4.4 |
| Corrosion inhibitor: benzene benzotriazole | 0.4 |
| Lubricity improver: methyl oleate | 1.3 |
| Cold flow improver: polymethacrylates | 6.6 |

Mix the multifunctional additive A5 (1 wt %) with −20# diesel fuel (90 wt %) and DMC (9 wt %) to produce −20#D10A5 diesel composition.

The properties of the −20#D20A5 diesel composition were tested by observing the phase separation of the composition when the temperature was slowly decreased (one degree Celsius for every two minutes). The results showed that no phase separation was observed in −20#D10A5 diesel composition until it was solidified at −21° C. Nor was any phase separation observed when the −20#D10A5 diesel composition was re-heated to room temperature.

Example 7

The following is an example of the multifunctional additive as disclosed herein and its effect in preventing phase separation.

Prepare multifunctional additive A6 according to the formulation in Table 10.

TABLE 10

| Formulation of multifunctional additive A6 | |
|---|---|
| Component | Weight Percent |
| Phase stabilizer: methyl acetate, n-octanol | 75.0 |
| Solubilizer: DMC | 20.0 |
| Cetane improver: di-t-butyl peroxide | 2.5 |
| Corrosion inhibitor: benzene benzotriazole | 0.5 |
| Lubricity improver: methyl oleate | 1.0 |
| Cold flow improver: polymethacrylate | 1.0 |

Mix the multifunctional additive A6 (3 wt %) with −35# diesel fuel (90 wt %) and DMC (7 wt %) to produce −35#D10A6 diesel fuel composition.

The properties of the −35#D10A6 diesel composition were tested by observing the phase separation of the diesel composition when the temperature was slowly decreased (one degree Celsius for every two minutes). The results showed that no phase separation was observed in −35#D10A6 diesel composition until it was solidified at −35° C. Nor was any phase separation observed when the solidified −35#D10A6 diesel composition was re-heated to room temperature. In comparison, −35# mix diesel made up of −35# diesel and 7% DMC did not show any phase separation until it was solidified at −33° C. The Cold Filter Plugging Point (CFPP) of the −35#D10 diesel composition was −29° C. while the CFPP of the −35# mix diesel was −15° C. Therefore, the −35#D10A6 diesel composition meets the standard of −35# diesel fuel, but the −35# mix diesel had higher solidifying point and CFPP, and could not be used as −35# diesel fuel.

TABLE 11

| Solidifying point and CFPP of −35#D10A6 diesel fuel composition | | |
|---|---|---|
| | Solidifying Point (° C.) | Cold Filter Plugging Point (° C.) |
| −35# diesel fuel | −35 | −29 |
| −35# mix diesel (−35# diesel + 7% DMC) | −33 | −15 |
| −35# D10A6 | −35 | −29 |

Example 8

The following is an example of using diesel fuel composition containing DMC and the multifunctional additive in construction and loading equipment.

Tests to determine the soot emission were conducted on an excavator (Hyundai Rolex 200-5). The results were shown in Table 12, which indicated that the diesel composition containing DMC and multifunctional additive could significantly decrease soot release in the excavator.

TABLE 12

| Soot emission test on an excavator | | |
|---|---|---|
| | Soot emission k (l/m) | Percent of soot emission decrease |
| 0# diesel fuel | 3.120 | — |
| 0# D20A1 (see Example 1) | 1.715 | 45% |

Tests to determine the soot release were conducted on a loader (LiuGong ZL50CN). The results were shown in Table 13, which indicated that the diesel composition containing DMC and the multifunctional additive can significantly decrease soot release in the loader. The results also showed that using more DMC and multifunctional additive could further decrease particulate emission.

TABLE 13

| Soot emission test on a loader | | |
|---|---|---|
| | Soot emission k (l/m) | Percent of soot emission decrease |
| 0# diesel fuel | 0.557 | — |
| 0# D5A1 (see Example 2) | 0.328 | 48% |
| 0# D10A1 (see Example 2) | 0.217 | 61% |

Example 9

The following is an example of using diesel fuel compositions containing DMC and the multifunctional additive in conditions mimicking high altitude environment.

Figure 2A:
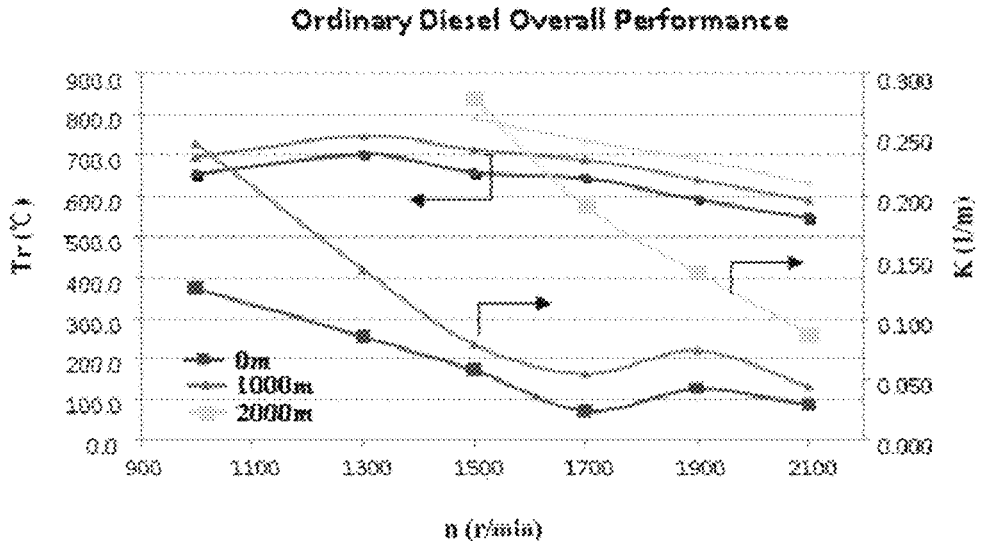
FIG. 2A shows the results of particulate emission test on a heavy duty diesel engine using normal diesel fuels (0#) under conditions mimicking high altitude environments. The performance of the diesel engine deteriorated as the altitude increased: the temperature of the emission increased and the soot emission increased.

FIG. 2 shows the results of particulate emission test on a heavy-duty diesel engine (see Table 3 for the parameters of the engine) under conditions mimicking high altitude environment. As shown in FIG. 2A, when using normal diesel fuels (0#) without DMC and the multifunctional additive, the performance of the diesel engine deteriorated as the altitude increased: the temperature of the emission increased and the soot emission increased in the high-power output curve. The results indicated that normal diesel fuel without DMC and the multifunctional additive could only be used in the diesel engine below the altitude of 2,000 meters.

Figure 2B:
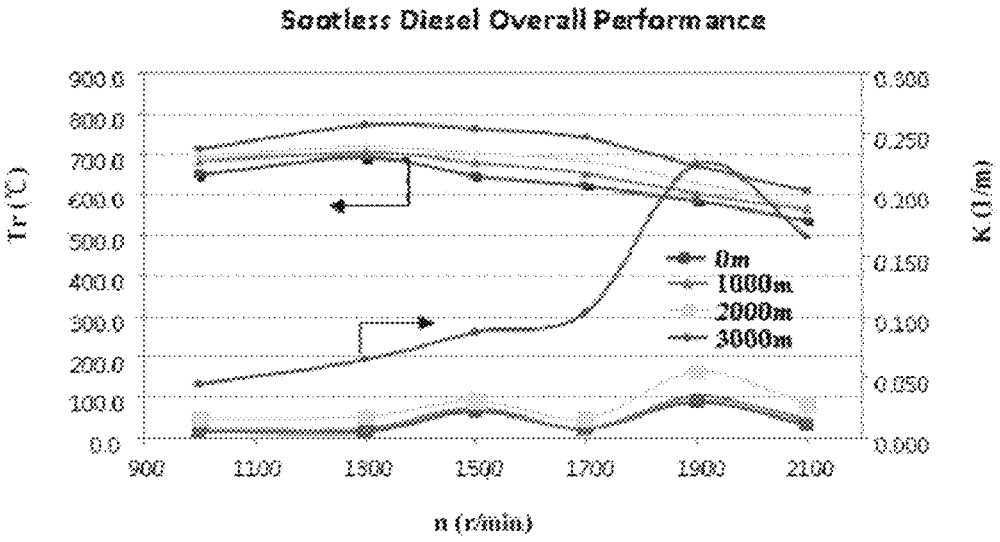
FIG. 2B shows the results of particulate emission test on a heavy-duty diesel engine using 0#D20A1 (diesel fuel composition containing DMC and the multifunctional additive A1) under conditions mimicking high altitude environments. Both the soot emission and emission temperature were decreased as compared to normal diesel fuels.

In contrast, using DMC and the multifunctional additive significantly decreased the soot emission as well as the temperature of emission. As shown in FIG. 2B, 0# D20A1 diesel composition (see Example 1 for detailed composition) could be used in the diesel engine at altitude of 2,000~3,500 meters.

While the invention has been particularly shown and described with reference to specific embodiments (some of which are preferred embodiments), it should be understood by those having skill in the art that various changes in form and detail may be made therein without departing from the spirit and scope of the present invention as disclosed herein.

What is claimed is:

1. A method for reducing soot emission comprising:

adding a composition comprising dimethyl carbonate and a multifunctional additive to a base diesel fuel to form a diesel fuel composition, wherein the base diesel fuel is present at 50~95 wt % of the diesel fuel composition; and using the diesel fuel composition in a diesel engine, wherein the diesel fuel composition comprises dimethyl carbonate present at 2-50 wt % of the diesel fuel composition, and the multifunctional additive present at 0.01-10 wt % of the diesel fuel composition, wherein the multifunctional additive comprises a phase stabilizer present at 20-99 wt % of the multifunctional additive, and a cetane improver present at 0.5-20 wt % of the multifunctional additive, wherein the phase stabilizer comprises a methyl ester of low carbon number, and an alkyl alcohol, an aromatic alcohol, a ketone, an ether, or a combination thereof.

2. The method of claim 1, wherein the diesel engine is operated at an altitude of at least 2000 meters.

3. The method of claim 1, wherein the methyl ester of low carbon number is selected from the group consisting of methyl acetate, methyl acrylate and methyl butyrate.

4. The method of claim 1, wherein the methyl ester of low carbon number is 80~90 wt % of the phase stabilizer.

5. The method of claim 1, wherein the alkyl alcohol is selected from the group consisting of methanol, ethanol, propanol, isopropanol, butanol, iso-butanol, pentanol, iso-pentanol, heptanol, octanol, iso-octanol, decanol and a combination thereof;

the aromatic alcohol is selected from the group consisting of benzyl alcohol, and phenethyl alcohol;

the ketone is selected from the group consisting of acetone, butanone and 2-butanone; and the ether is selected from the group consisting of methyl tert-butyl ether and di-ethylene glycol dimethyl ether.

6. The method of claim 5, wherein the ether is diethylene glycol dimethyl ether.

7. The method of claim 1, wherein the cetane improver is selected from the group consisting of iso-amyl nitrate, iso-octyl nitrate, cyclohexyl nitrate, butyl oxalate, dibutyl oxalate, di-iso-pentyl oxalate, di-tert-butyl peroxide, tert-butyl peroxybenzoate and a combination thereof.

8. The method of claim 7, wherein the cetane improver is di-tert-butyl peroxide or tert-butyl peroxybenzoate.

9. The method of claim 1, wherein the multifunctional additive further comprises a solubilizer present at 0~70 wt % of the multifunctional additive.

10. The method of claim 9, wherein the solubilizer is selected from the group consisting of alkyl carbonate, alkane, dimethylbenzene, ethylbenzene, isopropyl benzene and a combination thereof.

11. The method of claim 1, wherein the multifunctional additive further comprises a corrosion inhibitor present at 0.001~1 wt % of the multifunctional additive.

12. The method of claim 11, wherein the corrosion inhibitor is selected from the group consisting of 2,6-di-tert-butyl-4-methylphenol, 2,6-di-tert-butylphenol, N,N-di-tert-butyl-p-phenylenediamine, benzotriazole, tolyltriazole and a combination thereof.

13. The method of claim 1, wherein the multifunctional additive further comprises a lubricity improver present at 0.01~1 wt % of the multifunctional additive.

14. The method of claim 13, wherein the lubricity improver is selected from the group consisting of vegetable oils, fatty acids, aliphatic esters, aliphatic amines, ester amides, ester amide derivatives and a combination thereof.

15. The method of claim 1, wherein the multifunctional additive further comprises a cold flow improver present at 0.01~10 wt % of the multifunctional additive.

16. The method of claim 15, wherein the cold flow improver comprises vinyl acetate polymer, polymethacrylate, or a combination thereof.

17. A method for reducing soot emission comprising:

using a diesel fuel composition in a diesel engine, wherein the diesel fuel composition comprises a base diesel fuel present at 50~95 wt % of the diesel fuel composition, dimethyl carbonate present at 2-50 wt % of the diesel fuel composition, and a multifunctional additive present at 0.01-10 wt % of the diesel fuel composition, wherein the multifunctional additive comprises a phase stabilizer present at 20-99 wt % of the multifunctional additive, and a cetane improver present at 0.5-20 wt % of the multifunctional additive, wherein the phase stabilizer comprises a methyl ester of low carbon number, and an alkyl alcohol, an aromatic alcohol, a ketone, an ether, or a combination thereof.

18. The method of claim 17, wherein the methyl ester of low carbon number is selected from the group consisting of methyl acetate, methyl acrylate and methyl butyrate.

19. The method of claim 17, wherein the methyl ester of low carbon number is 80~90 wt % of the phase stabilizer.

20. The method of claim 17, wherein the alkyl alcohol is selected from the group consisting of methanol, ethanol, propanol, isopropanol, butanol, iso-butanol, pentanol, iso-pentanol, heptanol, octanol, iso-octanol, decanol and a combination thereof;

the aromatic alcohol is selected from the group consisting of benzyl alcohol, and phenethyl alcohol;

the ketone is selected from the group consisting of acetone, butanone and 2-butanone; and the ether is selected from the group consisting of methyl tert-butyl ether and di-ethylene glycol dimethyl ether.

* * * * *